US011073017B2

(12) United States Patent
Hyder et al.

(10) Patent No.: US 11,073,017 B2
(45) Date of Patent: Jul. 27, 2021

(54) IN-SITU BARRIER DEVICE WITH INTERNAL INJECTION CONDUIT

(71) Applicant: GCP Applied Technologies Inc., Cambridge, MA (US)

(72) Inventors: Md Nasim Hyder, Somerville, MA (US); Robert A. Wiercinski, Lincoln, MA (US); Jyoti Seth, Andover, MA (US); Greg Austin, Cambridge, MA (US); Christian A. Forgey, Lexington, MA (US); Sean Dsilva, Rocky Hill, CT (US)

( * ) Notice: Subject to any disclaimer, the term of this patent is extended or adjusted under 35 U.S.C. 154(b) by 0 days.

(21) Appl. No.: 16/612,393

(22) PCT Filed: May 10, 2018

(86) PCT No.: PCT/US2018/032035
§ 371 (c)(1),
(2) Date: Nov. 10, 2019

(87) PCT Pub. No.: WO2018/209063
PCT Pub. Date: Nov. 15, 2018

(65) Prior Publication Data

US 2020/0232322 A1 Jul. 23, 2020

Related U.S. Application Data

(60) Provisional application No. 62/504,506, filed on May 10, 2017.

(51) Int. Cl.
*E21D 11/38* (2006.01)
*E02D 19/18* (2006.01)
*E02D 31/02* (2006.01)

(52) U.S. Cl.
CPC ..... *E21D 11/381* (2013.01); *E02D 19/18* (2013.01); *E02D 31/02* (2013.01); *E21D 11/383* (2013.01);
(Continued)

(58) Field of Classification Search
CPC ..... E21D 11/381; E21D 11/383; E21D 11/38; E02D 19/18; E02D 31/02;
(Continued)

(56) References Cited

U.S. PATENT DOCUMENTS 741,589 A 10/1903 Mcbean
1,741,491 A * 12/1929 Ansell ..... B29D 23/001 138/126
(Continued)

FOREIGN PATENT DOCUMENTS

DE 2324097 3/1980
DE 2841452 3/1980
(Continued)

OTHER PUBLICATIONS

JP2004-060217 machine translation (Year: 2020).*
(Continued)

*Primary Examiner* — Brent W Herring
(74) *Attorney, Agent, or Firm* — Craig K. Leon

(57) ABSTRACT

The present invention provides a multi-layer barrier assembly or device for post-installation injection of a resin, grout, or other fluid. The barrier device comprises first and second layers defining an intermediate open-matrix layer, and at least one injection conduit member in parallel orientation with respect to the first and second layers and having openings for injecting fluid into the intermediate open-matrix layer. The injection conduit may be located between and in parallel orientation with respect to the first and second layers, along an edge of the first and/or second layers, along an outer face of the first layer (if the first layer is a woven or nonwoven fabric), or at any combination of these locations, to enable fluid to be conveyed into the intermediate open-matrix layer. The invention also provides for use of a gel activator within the barrier device cavity, such as pre-
(Continued)

installed on open-matrix structure which used for separating the first and second layers of the barrier device, such that a highly flowable injection fluid can be introduced into the device, and its gelation or hardening will be initiated or accelerated by the presence of the gel activator. This will allow for low power grout pumps to be used and facilitate the sealing of fine cracks in the surrounding concrete.

20 Claims, 12 Drawing Sheets

(52) U.S. Cl.
CPC .. *E02D 2250/003* (2013.01); *E02D 2300/002* (2013.01); *E02D 2300/0025* (2013.01); *E02D 2300/0076* (2013.01); *E02D 2300/0078* (2013.01)

(58) Field of Classification Search
CPC ..... E02D 2250/003; E02D 2300/002; E02D 2300/0025; E02D 2300/0076; E02D 2300/0078; E02D 31/04; B29L 2023/005
USPC ..... 52/742.13, 742.14, 742.16, 404.1, 406.1
See application file for complete search history.

(56) References Cited

U.S. PATENT DOCUMENTS

| | | | | | |
|---|---|---|---|---|---|
| 1,984,475 | A | * | 12/1934 | Goodall | F16L 11/10 138/127 |
| 2,263,070 | A | | 11/1941 | Cusick | |
| 2,357,769 | A | | 9/1944 | Robbins | |
| 3,099,911 | A | | 8/1963 | Turzillo | |
| 3,137,601 | A | | 6/1964 | Menzer | |
| RE25,614 | E | | 7/1964 | Turzillo | |
| 3,530,081 | A | * | 9/1970 | Durkee | C09K 17/48 524/789 |
| 3,780,975 | A | | 12/1973 | Turzillo | |
| 3,844,527 | A | | 7/1974 | Scott | |
| 3,969,852 | A | | 7/1976 | Krings | |
| 3,973,408 | A | | 8/1976 | Paverman | |
| 3,984,989 | A | | 10/1976 | Turzillo | |
| 4,110,151 | A | | 8/1978 | Morse | |
| 4,134,242 | A | | 1/1979 | Musz | |
| 4,177,618 | A | | 12/1979 | Felter | |
| 4,259,028 | A | | 3/1981 | Cook | |
| 4,370,078 | A | | 1/1983 | Gadelle | |
| 4,386,876 | A | | 6/1983 | Dupeuble | |
| 4,391,555 | A | | 7/1983 | Burger | |
| 4,391,556 | A | | 7/1983 | Burger | |
| 4,543,016 | A | | 9/1985 | Tallard | |
| 4,563,852 | A | | 1/1986 | Achtenberg | |
| 4,623,283 | A | | 11/1986 | Chew | |
| 4,712,347 | A | | 12/1987 | Sperber | |
| 4,730,805 | A | | 3/1988 | Yokota | |
| 4,754,590 | A | | 7/1988 | Gordon | |
| 4,787,597 | A | | 11/1988 | Yokota | |
| 4,905,441 | A | | 3/1990 | Landers | |
| 4,927,297 | A | | 5/1990 | Simpson | |
| 5,026,215 | A | | 6/1991 | Clarke | |
| 5,201,612 | A | | 4/1993 | Gadelle | |
| 5,245,812 | A | | 9/1993 | Landers | |
| 5,263,795 | A | | 11/1993 | Corey | |
| 5,287,674 | A | | 2/1994 | Sperber | |
| 5,365,716 | A | | 11/1994 | Munson | |
| 5,385,504 | A | | 1/1995 | Hussey | |
| 5,398,729 | A | * | 3/1995 | Spurgat | F16L 11/08 138/133 |
| 5,450,700 | A | | 9/1995 | Hackman | |
| 5,725,327 | A | | 3/1998 | Hussey | |
| 5,738,463 | A | | 4/1998 | Onan | |
| 5,792,552 | A | | 8/1998 | Langkamp | |
| 5,819,496 | A | | 10/1998 | Sperber | |
| 5,819,850 | A | | 10/1998 | Lee | |
| 5,836,390 | A | * | 11/1998 | Apps | C09K 17/12 166/281 |
| 5,842,519 | A | | 12/1998 | Sydansk | |
| 5,891,549 | A | | 4/1999 | Beretta | |
| 5,911,539 | A | | 6/1999 | Egan | |
| 6,202,370 | B1 | | 3/2001 | Miller | |
| 6,290,021 | B1 | | 9/2001 | Strandgaard | |
| 6,588,986 | B1 | | 7/2003 | Sibilla | |
| 6,655,107 | B2 | | 12/2003 | Dean | |
| 6,662,516 | B2 | | 12/2003 | Vandehey | |
| 6,691,472 | B2 | | 2/2004 | Hubert | |
| 6,699,915 | B2 | | 3/2004 | Hilton | |
| 6,976,804 | B1 | | 12/2005 | Asplin | |
| 7,032,660 | B2 | | 4/2006 | Vinegar | |
| 7,077,198 | B2 | | 7/2006 | Vinegar | |
| 7,565,779 | B2 | | 7/2009 | Iske et al. | |
| 7,584,581 | B2 | | 9/2009 | Iske et al. | |
| 7,823,356 | B2 | | 11/2010 | Tanaka | |
| 7,836,650 | B2 | | 11/2010 | Iske | |
| 7,900,418 | B2 | | 3/2011 | Iske | |
| 8,039,081 | B2 | | 10/2011 | Ianniello | |
| 8,291,668 | B2 | | 10/2012 | Iske | |
| 9,127,467 | B2 | | 9/2015 | Johnson | |
| 9,366,033 | B2 | | 6/2016 | Johnson | |
| 9,476,196 | B2 | | 10/2016 | Wiercinski | |
| 2002/0157344 | A1 | | 10/2002 | Dean | |
| 2003/0161691 | A1 | | 8/2003 | Marshall | |
| 2003/0224143 | A1 | | 12/2003 | Ianniello | |
| 2004/0168802 | A1 | | 9/2004 | Creel | |
| 2004/0200173 | A1 | | 10/2004 | Drake | |
| 2006/0010826 | A1 | | 1/2006 | Canteri | |
| 2006/0191224 | A1 | | 8/2006 | Iske | |
| 2007/0175127 | A1 | | 8/2007 | Tanaka | |
| 2009/0126291 | A1 | | 5/2009 | Iske | |
| 2009/0173025 | A1 | | 7/2009 | Fay | |
| 2009/0274518 | A1 | | 11/2009 | Iske | |
| 2009/0282762 | A1 | | 11/2009 | Iske | |
| 2013/0276392 | A1 | | 10/2013 | Johnson | |
| 2018/0223523 | A1 | * | 8/2018 | Koster | E04B 1/665 |

FOREIGN PATENT DOCUMENTS

| | | |
|---|---|---|
| EP | 1267035 | 12/2002 |
| JP | 2004060217 | 2/2004 |
| WO | 1999067183 | 12/1999 |
| WO | 2005040555 | 5/2005 |
| WO | 2006091867 | 8/2006 |

OTHER PUBLICATIONS

Egger et al., "Achieving Dry Stations and Tunnels with Flexible Waterproofing Membranes," Feb. 25, 2005, 7 pages.
Young, Lee, International Search Report & Written Opinion for PCT/US06/06693, dated Nov. 6, 2007, United States Patent and Trademark Office as International Search Authority, 9 pages.
Danissen, Paulina, International Search Report & Written Opinion for PCT/US06/34079, dated Jul. 17, 2007, European Patent Office as International Search Authority, 10 pages.
Various web site information on drainage mats (including SuperDrain, Enkadrain, Terradrain, Senergy, Tenax, Ultradrain, AmerDrain, J-Drain, Fondavis, Ruble, Terram, and Mirafi drainage mats), 58 pages, 2006.
Enkamat Permanent Erosion Prevention Mat, product manual, Colbond, 16 pages.
A Brief Introduction to Non-Woven Fabrics, Biovation LLC, 3 pages, 2010.
Standard Application Procedures for Sealing Leaking Cracks or Joints with Grouts, Grace Construction Products, 6 pages.

* cited by examiner

IN-SITU BARRIER DEVICE WITH INTERNAL INJECTION CONDUIT

FIELD OF THE INVENTION

The invention relates to a barrier device for post-installation injection of a waterproofing fluid; and, more particularly, to a multi-layer device having first and second layers defining an intermediate open-matrix layer, and at least one injection conduit member disposed in parallel orientation with respect to the first and second layers to permit a waterproofing fluid to be injected into the open-matrix layer. The at least one injection conduit member may be located between the first and second layers and thus within the open matrix layer, at the edge of the multi-layer device and adjacent to an open matrix layer, along an outer face of the first layer if the first layer is made of nonwoven or woven fabric, or combination of these locations, whereby an injection fluid can be conveyed through the conduit member and into the open matrix layer.

BACKGROUND OF THE INVENTION

The use of multi-layer devices for post-installation, in-situ creation of barriers for waterproofing of concrete constructions is known. An applicator places such devices against a substrate, such as formwork or existing wall, and applies concrete against the devices. Thereafter, an applicator can inject a waterproofing fluid into the devices. The waterproofing fluid may comprise waterproofing resins or cements, insecticides, mold preventatives, rust retardants, and the like, for creating a watertight barrier, or so-called "grout wall," to protect the concrete structure. The injection of the fluid allows for remedial waterproofing treatment after installation of the device and after spraying or casting concrete against the device.

Brian Iske and others disclosed various devices for the creation of grout walls in U.S. Pat. Nos. 7,584,581, 7,836,650, 7,900,418, and 8,291,668, owned by the common assignee hereof. The grout wall devices can be attached to the exterior of a shoring system, a tunnel excavation wall, a concrete formwork, or other substrates or structures.

Characteristic of the Iske devices were a plurality of injection tubes that jutted perpendicularly out of the outermost layer of the multi-layered devices. The orientation and placement of these perpendicularly, outward-extending tubes enabled injection of the waterproofing fluid (e.g., grouts, resins, etc.) into the device after concrete was applied against the exterior of the installed multi-layer device. After the concrete was cast or sprayed against the installed device, Iske et al. taught that applicators could pump the waterproofing composition into the multi-layered device and thus completely fill the interior of the multi-layer device using spaced-apart tubes or pipes. The tubes or pipes extended perpendicularly through the outermost layer of the devices and through the placed concrete structure and required placement to ensure that the injection fluid would be able to fill completely the multi-layer device behind the concrete (See e.g., U.S. Pat. No. 7,836,650 at FIGS. 5-6).

The present inventors believe that such prior art multi-layer grout wall devices, due to the large number of perpendicularly extending tubes or pipes, required enormous preparation work on site, even when the devices were installed as pre-assembled integral units. The use of the perpendicularly extending tubing required a lot of preparation and steps during the injection process to ensure that a continuous grout wall could be established between the devices and the concrete placed against the devices.

SUMMARY OF THE INVENTION

In surmounting the deficiencies of the prior art, the present invention provides a multi-layer device that enables faster and more convenient installation of a grout wall system, and particularly for establishing a grout wall using an assembly of such multi-layer devices.

An exemplary device of the invention for post-installation in-situ barrier creation, comprises: a multi-layer fluid delivery device comprising first and second layers defining an intermediate open-matrix layer for an injection fluid; the first layer having an inwardly facing surface and an outwardly facing surface, the first layer being permeable to the injection fluid but at least nearly impermeable to a structural construction material to be applied against the outwardly facing surface of the first layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining an open-matrix layer for conducting an injection fluid between said first and second layers; and at least one injection conduit member disposed in parallel orientation with respect to the first layer and second layer, the at least one injection conduit member for conveying an injection fluid into the open-matrix intermediate layer air space; and the at least one injection conduit member being: (i) located within the open-matrix layer and thus between the first and second layer, (ii) located adjacent the open-matrix layer; (iii) located against the outwardly facing surface of the first layer which is permeable to injection fluid; or (iv) located in a combination or all of the foregoing locations (i), (ii), and (iii).

The injection fluid may be chosen from waterproofing resin, grout, cement, insecticide, mold preventative, rust retardant, and mixtures thereof.

In further exemplary embodiments, the first layer is permeable to the injection fluid and nearly impermeable to the structural construction material (e.g., concrete), and comprises a non-woven or woven fabric; while the second layer is water-impermeable, and comprises a polymer film (e.g., polyethylene, polypropylene).

While the invention contemplates that the multi-layer device can be assembled from separate components at the construction site, the inventors believe that it is more convenient, efficient, and faster to use pre-assembled multi-layer devices, so that installation effort and time are minimized. In either case, one creates an "in situ" (or "in place") barrier system that defines a confined flow area for injection fluids such as waterproofing resins and grouts.

The present invention has particular value in vertical wall applications, especially for sealing to prevent leakages at cold joints, as defined between concrete floors and subsequently poured vertical walls. The device is assembled or installed as a pre-assembled unit against a substrate (e.g., excavation, existing wall or foundation, formwork or mold, tunnel wall, etc.), and, subsequently, concrete is cast or sprayed against its outward-facing layer. The device may also be assembled or installed in horizontal applications, such as sub-layer or subflooring for concrete slabs, decks, and floor applications, including applications where the existence and location of joints and segment dimensions are not predictable or uniform. In either horizontal or vertical applications, the devices and assemblies of the invention can protect against moisture penetration due to crack formations or other leakage pathways formed within or between concrete structures.

In other exemplary embodiments, the outward face layer of the multi-layer device is preferably porous, such as in a nonwoven or woven fabric, which allows the injection fluid to fill in the open-matrix intermediate layer and flows through the outward face porous layer to fill in voids or discontinuities in the construction material (e.g., concrete) that is cast or sprayed against the multi-layer device.

The present invention also has particular value in shotcrete applications, wherein concrete is sprayed against the outward face of the device. When the device of the invention is installed against a wall, and concrete is poured or spray-applied against rebar adjacent the installed device, the device will allow a subsequently injected resin or grout to permeate through the outward face porous layer and fill in "shadow" areas where the rebar interrupts the path of the poured or sprayed concrete (or shotcrete), thereby creating a full contact seal with the concrete (or shotcrete).

In other embodiments, the barrier devices of the present invention having the at least one injection conduit member in parallel orientation with respect to the first and second layers are provided in rollable or stacked form that can be used conveniently and quickly at the construction site. In other words, two or more pre-assembled multi-layer fluid delivery units can be connected together to form a monolithic barrier layer wherein their at least one injection conduit member(s) are connected to permit an injection fluid (e.g., grout, resin, cement) to be pumped through and/or into several barrier devices at once, thereby creating a monolithic water-resistive curtain over an area that is larger than an individual barrier device. The concrete which is subsequently cast or sprayed against the installed barrier devices allow the in-situ barriers to stay in place during fluid injection, and to resist the compressive pressure required to inject the fluid into the open-matrix intermediate layer and through the permeable outward porous (e.g., woven or nonwoven) fabric which comprises the outward face layer.

In further exemplary multi-layer barrier devices of the invention, the layer installed against a formwork or other substrate comprises a water-impermeable polymer film (e.g., polyolefin), and the layer disposed outwards for bonding with cast or sprayed concrete comprises a non-woven material (e.g., polypropylene, nylon, polyamide). The film layer side of the device can be attached to formwork, an existing wall, or other substrate using a two-sided tape or pre-attached pressure-sensitive adhesive layer. The outward-facing non-woven layer, on the other hand, allows for permeation of the injection fluid (e.g., grout, resin, cement) into and out of the intermediate open-matrix layer, while essentially blocking concrete or other construction material cast against the barrier device from entering into the open-matrix intermediate layer.

The present invention also provides a method for creating an in-situ barrier device (or assembly), wherein the above barrier device is attached or assembled against an excavation wall, lagging form, or shoring system, where concrete is thereafter applied (e.g., sprayed, poured) against the outer layer of the barrier device; and an injection fluid is subsequently injected through the at least one injection conduit and into the space defined by the open-matrix intermediate layer.

Especially preferred devices of the invention comprise one or more injection conduit members disposed in parallel orientation with respect to the first and second layers, and can be (i) located within the open-matrix layer and thus between the first and second layer, (ii) located adjacent the open-matrix layer (along an edge of the device); (iii) located against the outwardly facing surface of the first layer which is permeable to injection fluid; or (iv) located in a combination or all of the foregoing locations (i), (ii), and (iii).

The present invention avoids the inconvenience of having to install numerous injection tubes extending perpendicularly across the outward face of the device, as well as the inconvenience of applying concrete around the perpendicularly extending tubes.

In a further exemplary multi-layer device of the invention, a gelation activator is pre-applied within the open-matrix layer defined between the first and second layers (hereinafter "gel activator"). The gel activator functions as an accelerator, catalyst, hardener, resin and/or curative agent to increase or to initiate gelation (e.g., hardening, stiffening, polymerization) of the injection fluid once it is introduced into the open matrix layer. For example, the injection fluid could be a polyol resin, and the gel activator could be an isocyanate functional resin, to generate a polyurethane grout wall composition within the barrier device.

As another example, the injection fluid could be an isocyanate resin, and the gel activator could be an amine resin, to generate a polyurea grout wall within the barrier device. An amine gel activator or a free radical gel activator could be used for injection fluids that were based on polyacrylate. A still further example involves use of an epoxy resin injection fluid, and an amine resin as gel activator.

As another example, the gel activator for hydratable cementitious injection fluids could be a set accelerator (e.g., calcium nitrite and/or nitrate) to quicken the setting of the cement. As yet another example the injection fluid may comprise a sodium silicate solution and the gel activator may comprise an acid or an alkaline earth salt or an aluminum salt. The gel activator is pre-installed or preapplied (e.g. coated, sprayed, brushed) into the open-matrix layer structure, such as into a non-woven geotextile mat used for separating the first and second layers of the barrier device. Consequently, a highly flowable injection fluid can be introduced into the barrier device without the need for high-powered, multi-component pump equipment. A simple, single component pump equipment is used. Upon contact with the gel activator located within the open-matrix layer, the injection fluid will begin to gel (e.g., assume higher viscosity) and ensure that a grout wall is established against concrete that was cast against the installed barrier.

The present inventors believe that the use of a pre-installed gel activator will benefit the use of the hereindescribed barrier devices having injection conduit members disposed in parallel orientation with respect to the first and second layers. The pre-installed gel activator will also benefit conventional grout wall barrier designs (e.g., U.S. Pat. No. 7,565,799) which employ tubes extending perpendicularly from the structure. Hence, another exemplary multi-layer fluid delivery device of the present invention comprises first and second layers defining an intermediate open-matrix layer for an injection fluid; the first layer having an inwardly facing surface and an outwardly facing surface, the first layer being permeable to the injection fluid but at least nearly impermeable to a structural construction material to be applied against the outwardly facing surface of the first layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining an open-matrix layer for conducting an injection fluid between said first and second layers; and at least one injection conduit member disposed in parallel orientation with respect to the first layer and second layer, the at least one injection conduit member for conveying an injection fluid into the open-matrix intermediate layer air space; and the at least one injection conduit member being (a) located within the open-matrix layer and thus between the first and second layer, (b) perpendicular and connected to and disposed outside of the open-matrix layer; or (c) both (a) and (b); and having a gel activator located within the open-matrix structure. The present invention thus provides barrier devices and methods, wherein a gel activator is pre-installed, wherein gelation is initiated or accelerated in injection fluids introduced through parallel and/or perpendicular injection tubes, or even where injection fluid is introduced without injection tubes but through holes drilled in concrete that was hardened against the installed barrier device.

Further features and benefits of the invention are described hereinafter.

BRIEF DESCRIPTION OF THE DRAWINGS

The present invention may be more readily comprehended when the following written description of exemplary embodiments is considered in conjunction with the drawings, wherein.

DETAILED DESCRIPTION OF PREFERRED EMBODIMENTS

Figure 1:
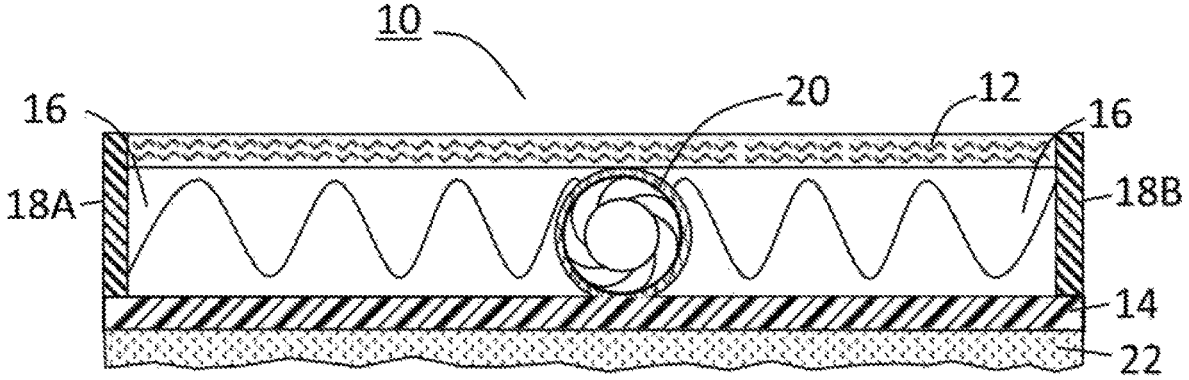
FIG. 1 is a diagram of an exemplary multi-layer device of the invention having at least one injection conduit member such as polymer tubing (openings not shown)

The present invention relates to a multi-layer assembly or device for a post-installation in-situ barrier, as well as a method for assembling the barrier, using one or more injection conduit members that are parallel to the major faces or layers of the assembly or device, in contrast to the prior art use of perpendicularly extending pipes as taught by Iske et al. as mentioned in the Background section.

The terms "assembly" and "device" may be used interchangeably throughout this specification. Ideally, relatively little assembly of an individual multi-layer device is required at the construction site, although the establishment of a grout wall against concrete that is poured or sprayed against a number of such individual multi-layer devices will require some "assembly" to join individual multi-layer devices together, including injection conduit members to permit filling two or more of the devices using a single source of injection fluid. (This will be described further hereinafter during discussion of FIGS. 3A and 3B).

As will be explained in further detail hereinafter, two or more multi-layered devices can be joined together, thereby allowing for the creation of a grout wall to seal against subsequently applied concrete, using injection conduit members which can be (i) located within the open-matrix layer and thus between the first and second layers of the multi-layered device, (ii) located adjacent the open-matrix layer at an edge of one or more multi-layered devices; (iii) located against the outwardly facing surface of the first layer(s) which is permeable to injection fluid; or (iv) located in a combination or all of the foregoing locations (i), (ii), and (iii).

For example, a barrier device can be assembled at a construction site by providing the multi-layer device having a first layer (e.g., a nonwoven which is permeable to a waterproofing grout, resin, cement, or other injection fluid), a second layer (e.g., a water-impermeable polymeric film), and an open-matrix structure for connecting the first and second layers together but defining a space for filling with injection fluid; and an injection conduit (e.g., spiral wrap tubing) can be taped against the first layer (nonwoven) in a manner to allow injection fluid to be pumped through the nonwoven first layer so as to fill the intermediate open-matrix layer and to fill any gaps or discontinuities in concrete which is applied against the outer layer of the device.

As another example, the barrier device can be adhered in strip form against a substrate, and an injection conduit member can be placed next to one or both edges along the strip, and taped in place, such that injection fluid can be pumped through and out of the injection conduit member and into the intermediate open matrix layers of the adjacent barrier device or devices.

As a further example, the multi-layer barrier device may be pre-assembled having at least one integral injection conduit member between the first and second layers and thus embedded already within the intermediate open-matrix layer. This may facilitate installation, as well as waterproofing performance, because the applicator may also install additional injection conduit members in parallel fashion along an edge and/or outward face of the barrier devices, whereby an injection grout, cement, resin, or other fluid can be introduced from openings along the length of the injection conduit member into spaces within the intermediate open-matrix layers of the barrier devices.

As shown in the plan cross-sectional diagram of FIG. 1, an exemplary device 10 for post-installation in-situ barrier creation comprises a first layer 12 and second layer 14 which define an intermediate open-matrix layer 16, and at least one injection conduit member 20 that is disposed in parallel orientation with respect to and between the first and second layers 12/14. In further exemplary embodiments, the length of the at least one conduit member 20 is preferably substantially coextensive with a width or length of the device 10. The at least one injection conduit member 20 has openings (not shown in this view) for introducing an injection fluid between the first layer 12 and second layer 14 and into the spaces within the open-matrix intermediate layer 16.

In further exemplary devices or assemblies of the invention, the first layer 12 of the at least two spaced-apart layers is preferably non-permeable or semi-permeable to the injection fluid which is introduced into the intermediate open-matrix layer 16; while the second 14 of the at least two spaced-apart co-extensive layers is preferably a polymer film which is non-permeable to the injection fluid which is introduced into the intermediate open-matrix layer 16. For example, the first layer 12 can be a non-woven synthetic fabric of the kind used for bonding with fresh concrete cast or sprayed against it and allowed to cure into a hardened state.

In a further exemplary embodiment, a pressure-sensitive adhesive layer 22 may be attached to the second layer 14 to facilitate installation of the device or assembly 10 against a substrate, such as an excavation wall, a concrete wall or foundation, a formwork, a scaffolding structure, or other mounting surface.

FIG. 1 also illustrates the exemplary use of optional containment members (designated at 18A and 18B) for enclosing the space defined by the open-matrix layer 16 that is intermediate between the first layer 12 and second layer 14. The containment layers 18A/18B may comprise, for example, an adhesive tape for sealing the edges and thereby joining the first layer 12 and second layer 14. Alternatively, the containment members 18A and 18B may be provided or formed by folding extending sides of a wider or longer second layer 14 (particularly if the second layer is an impermeable film) around the edge of the intermediate open-matrix layer 16 and attaching the extended sides (18A/18B) onto the first layer 12 of the barrier device 10, either at or before installation.

In other exemplary embodiments, the first layer 12 is preferably made from a synthetic felt or other non-woven fiber material, which is permeable to the injection grout, resin, cement or other fluid, but partly impermeable to fresh concrete that is cast against it. By "partly impermeable," it is intended that the fresh concrete is able to flow into interstices between the fibers of the felt or non-woven fiber material and to create a bond with the concrete when the concrete becomes hardened; and it is preferable to select the felt or non-woven fiber material such that the concrete does not entirely penetrate into the intermediate open-matrix layer 16 thereby to prevent the grout, resin, or other injection fluid from being able to fill up the spaces defined by the open matrix layer 16 within the barrier device 10, or to block the injection fluid from permeating the nonwoven, felt, or other fiber material which constitutes the first layer 12 and from filling gaps or discontinuities between the applied concrete and the first layer 12.

Various exemplary structures 16 can be used for spacing apart the first and second layers 12/14 and defining the space within the intermediate open-matrix layer 16. For example, in U.S. Pat. No. 7,565,779, Iske et al. taught the use of frusto-conical shaped structures in addition to other protuberances, wave-shaped ribs, and geotextile non-woven layers. At column 10, lines 3 and following, Iske et al. identified commercially available construction drainage products that could be utilized in forming the open-matrix layer, for example, Colbond Enkadrain®, Pozidrain®, Terradrain®, Senergy®, Tenax®, Blanke Ultra-Drain®, AmerDrain®, Superseal SuperDrain®, J-Drain®, Viscoret® dimpled membrane, Terram® drainage composites, and Delta®-MS drainage membranes. The present inventors consider these various brands of geotextile products to be suitable for use in the present invention, and their selection would be subject to the preference of the device designer, assuming compatibility with the size of internal injection fluid conduit tubing 20 used between the first and second layers 12/14 of the barrier device 10.

For exemplary intermediate open-matrix layers 16 having a fast filling area for containing the injection fluid while providing rollability and sufficient structure to the multi-layer device, the present inventors contemplate the use of a three-dimensional membrane with open cell structure formed by continuous extrusion of two intersecting high density polyethylene (HDPE) strands to form a high profile, biaxial netlike mesh. The polymer strands may intersect randomly, and the form the shape of evenly spaced ribs or undulations, for spacing apart the first layer 12 and second layer 14, and permitting air channels having high capacity for the injection of chemical fluids such as grouts, resins, and cements which are typically used in waterproofing. The present inventors believe that three-dimensional geosynthetic textiles provide high fluid flow characteristics in both machine and cross directions without generating unnecessary flow resistance. Such open matrix structures will allow uniform flow of the injected fluid and create a curtain wall (e.g., chemical grout) in every direction.

The preferred thickness of this exemplary open-matrix layer is about ⅛ inches to ⅜ inches. The density of the open-matrix layer may, for example, be in the range of 20 $gm/ft^2$ to 80 $gm/ft^2$, more preferably between 30 $gm/ft^2$ to 70 $gm/ft^2$, and most preferably between 45 $gm/ft^2$ to 60 $gm/ft^2$.

As mentioned above, the second layer 14 is preferably a water-impermeable polymer film (e.g., polyolefin). More preferably, both first layer 12 and second layer 14 will each have linear edges along their respective width and length dimensions. If an injection conduit member 20 is positioned parallel to one of the width or length linear edges of the device 10, it may comprise a plurality of openings to permit an injection fluid to be introduced into the intermediate open-matrix layer 16 of a given device 10, or have separate holes or "T" or "X" joints to permit fluid communication/connection to injection conduit members that are located within the devices 10.

Figure 2:
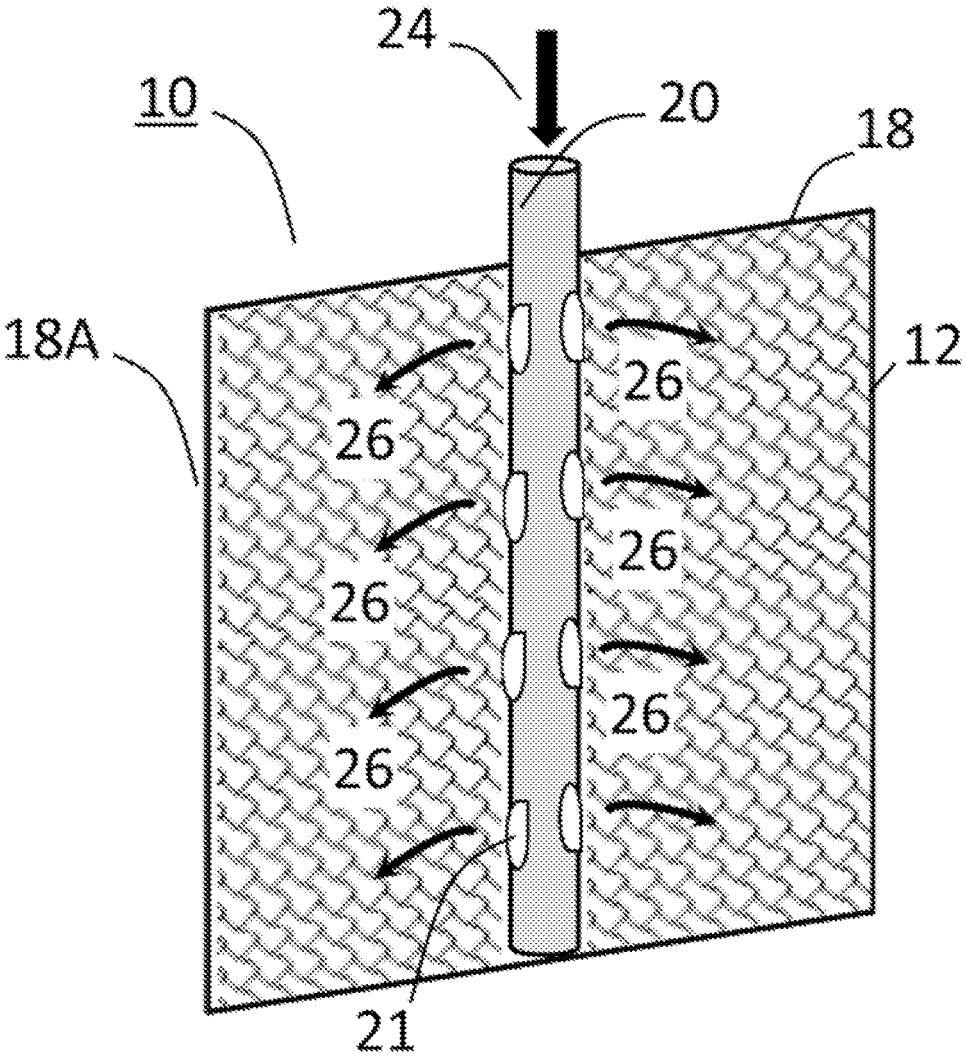
FIG. 2 is a perspective illustration of an exemplary multi-layer device of the invention whereby an injection fluid can be introduced into an intermediate open-matrix layer through openings in the injection conduit member (e.g., polymer tubing)

As shown in FIG. 2, an exemplary multi-layer fluid delivery device 10 of the invention comprises at least one injection conduit member 20 positioned between the at least two spaced-apart first and second layers 12 and 14 (where only the first layer 12 is illustrated). In this embodiment, the one or more injection conduit member(s) is/are contained integrally within the intermediate open-matrix layer 16 and preferably shipped as a pre-assembled unit. The injection conduit member 20 may comprise a flexible plastic (e.g., nylon) tubing having openings 21, such as slits, which move resiliently into an opened position when injection fluid which is pumped into an end of the piping 24 to permit the injection fluid (26) to exit into the open-matrix layer (16). The slit openings 21 should return to a closed position when the injection fluid is no longer subject to pressure.

In further exemplary embodiments, the injection conduit member 20 can be formed by spiral wrapping of a ribbon shaped polymer to form a tubing; whereby openings to allow exit of the injection fluid are defined by spaces between the spiral wrap. A further variation of this concept is to employ two concentric spiral wrapped tubings, wherein the spiral direction may be same or opposite. Where two concentric spiral wraps are used to define a conduit 20 tubing, the innermost concentric spiral wrap tubing will function to convey an injection fluid through the length of the tubing; and the outermost concentric spiral wrap tubing will function to control expansion of the innermost tubing and to minimize or prevent re-entry of fluid that has been ejected from the innermost tubing. Again, the "opening" of the conduit member in this case is defined by the spaces between the respective spiral wrappings which form the tubing.

In a further exemplary injection conduit member, a mesh sleeve which is made by woven or braided fibers of polyolefin (e.g., polyethylene, polypropylene) or polyamide (e.g., NYLON), may be positioned concentrically outside of one or more spiral wrap tubing members to control the expansion of the tubing(s) under pressure and to protect the integrity of the tubing shape formed by the spiral wrappings.

In a still further exemplary injection conduit member, a polymer mesh (braided or woven) sleeve or one or more spiral wrapping tubing(s) can be concentrically arranged around a metal or plastic spring. The spring helps to resist collapse of the tubing when the device is in rolled or unrolled form, and particularly where the barrier device is installed or assembled in locations which will be subject to large compressive forces (large rocks) or potential mechanical threats (movement of large structures such as rebar or machinery) in the vicinity of the barrier device 10 installation or assembly.

In other exemplary embodiments, the multi-layer fluid delivery device 10 is pre-assembled with one or more injection conduit members 20 located within the intermediate open-matrix layer, against an outer edge of the device, or along the outward nonwoven layer of the device (or combination thereof). Regardless of whether the injection conduit members are pre-assembled in combination with the multi-layer structure, the barrier unit may be conveniently and relatively easily rolled up for shipment and unrolled at the construction site for installation. Accordingly, an exemplary device 10 of the invention comprises the at least two spaced-apart layers 12/14, the intermediate open-matrix layer 16, and the at least one injection conduit member 20 pre-assembled into an integral unit and transportable in a rolled form. At the site, two or more exemplary devices 10 having integral injection conduit members 20 can be assembled together to form a monolithic in-situ barrier.

While FIG. 2 shows an exemplary device or assembly 10 that is installed in a vertical fashion, with an injection conduit member 20 extending out of the intermediate open-matrix layer 16, the device 10 may be installed or assembled horizontally as well. The ends of the injection conduit members 20 may terminate flush with an edge of the device 10, may extend beyond the edges, or may be recessed within the first and/or second layer 12/14 edges.

Figure 3A:
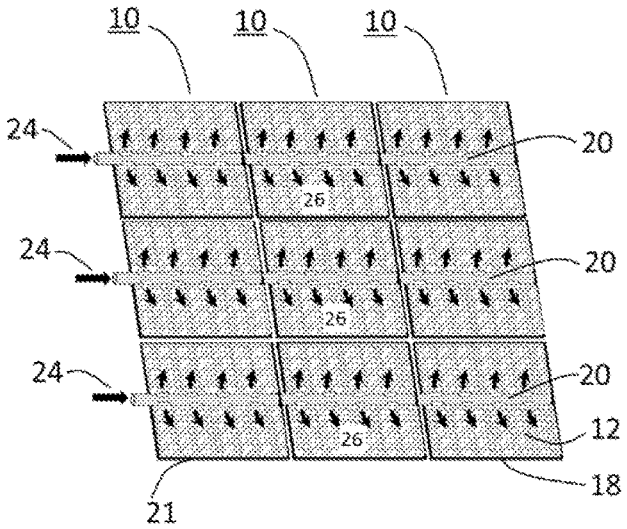
FIGS. 3A and 3B are perspective illustrations of exemplary multi-layer device assemblies of the invention wherein conduit members are shown in an interconnected arrangement.
Figure 3B:
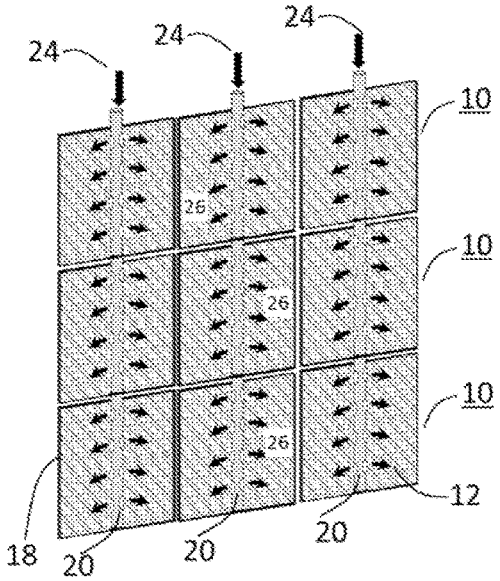

FIGS. 3A and 3B each illustrate an assembly of nine multi-layer fluid delivery devices 10. Horizontally positioned injection conduit members 20 are connected to conduit members 20 of adjacent devices to create a monolithic barrier structure, as illustrate in FIG. 3A; while vertically positioned injection conduit members 20 are connected to conduit members 20 of adjacent devices to create a monolithic barrier structure, as illustrated in FIG. 3B. A grout, resin, cement, or other injection fluid 24 introduced 24 into ends of connected conduit members 20 will flow through the conduit members 20 and enter the intermediate open-matrix layers of the connected devices 10. While FIG. 3A shows arrows for injecting fluid from the left side of the devices 10, injection fluid may also be simultaneously injected from the right side of the devices 10 as well. The numerous devices 10 of the invention can be connected together using waterproofing tape to connect the various first layers 12 of the devices 10 to each other and to connect the various second layers to each other. The tape can be used to seam the outermost edges of the conjoined first and second layers together (as designated at 18 in FIG. 3A) so as to define a containment space into which the injection fluid may flow. One end of the injection conduit members 24 may be capped, clamped, or otherwise plugged so that fluid (e.g., resin, grout, concrete) injected into the tubing 24 under pressure is allowed to completely fill the device. (Note that the devices 10 of FIGS. 3A and 3B are simplified so that it is shown how the conduit members 20 are disposed parallel to one of the layers (and could be located within the device or against an outward faces of the first layers 12 (e.g., nonwoven) of the devices 10.

Figure 4:
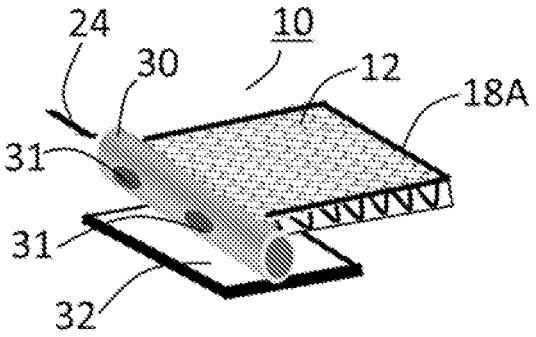
FIG. 4 is a perspective illustration of an exemplary injection conduit member with flange for connecting other multi-layer devices to a common conduit member.

FIG. 4 illustrates an exemplary injection conduit member 30 situated along an edge of a device 10 in parallel orientation with respect to the layers (e.g., 12) and intermediate, parallel to the intermediate open-matrix layer. The conduit member 30 is shown having openings 31 for communicating with the spaces within the open-matrix layer or layers 16 or for connecting to further conduit members that may be located within the intermediate open-matrix layer. The exemplary conduit member 30 shown in FIG. 4 is shaped as a tube, preferably although not necessarily having at least two flange members (designated at 32) to facilitate attachment and seaming of the conduit member 30 to the barrier injection device 10. Exemplary connector conduit members 30, as shown in FIG. 4, may be supplied as part of a kit comprising a number of the barrier devices 10 to facilitate quick installation of a monolithic barrier. The connector conduit members 30 can be used to inject a waterproofing resin or grout or other fluid into devices 10 that do not have integral injection conduit members 20, or into two or more devices each of which contain one or more injection conduit members. A tape may be used opposite against the conduit member 30 on the side opposite the flange 32 to provide a seal between the layer 12 and injection conduit member 30.

A barrier of the present invention for creating a grout wall may be assembled at the construction site using (a) a multi-layer device that does not contain an injection conduit member; and (b) an injection conduit member that is installed along an edge of the device (See e.g., FIG. 4).

Figure 5:
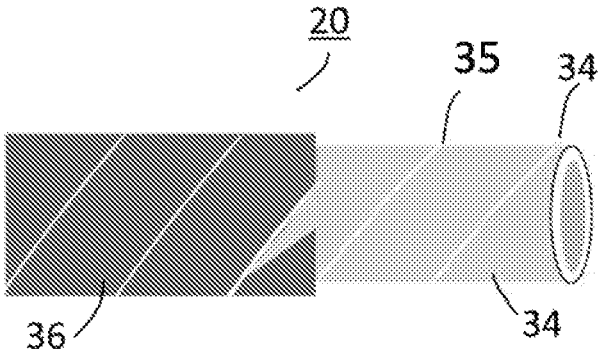
FIGS. 5 and 6 are exploded diagrams of other exemplary injection conduit members of the invention having one or more sleeves.

FIG. 5 illustrates an exemplary injection conduit member 20, mentioned above, which employs concentric spiral wrap sleeves (designated at 34 and 36) to form tubing that is effective for conveying an injection fluid. The conduit member 20 comprises an outer spiral wrap sleeve member 36 surrounding an inner spiral wrap sleeve member 34. By tightly wrapping the inner spiral wrap 34, slit openings (designated as at 35) are formed in the inner spiral wrap sleeve 34. An outermost spiral wrap sleeve member 36, as shown in FIG. 5, helps to control expansion of the inner sleeve 34 and prevents injection fluid from re-entering it. The inner 34 and outer 36 spiral wrap sleeves may have the same or opposite spiral directions. The material for making the spiral wrap sleeve may be chosen from a polyolefin (e.g., polyethylene, polypropylene, or mixtures thereof), a polyamide (e.g., nylon), or combinations thereof.

Figure 6:
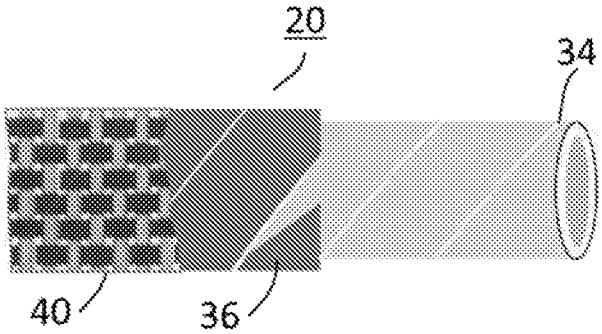

As shown in FIG. 6, another exemplary injection conduit member 20 comprises at least one and optionally two spiral wrap sleeve members, and further comprises an outer mesh sleeve member 40 to protect and/or to control expansion of inner spiral wrap sleeve member or members. When one or two wrap members are surrounded lengthwise by a mesh sleeve member 40, a greater degree of protection against clogging and re-entry of injection fluid is provided. The mesh sleeve member 40 may be made of a woven or braided material, and may comprise a polyolefin (e.g., polyethylene, polypropylene, or mixtures thereof), a polyamide (e.g., nylon), or combinations thereof.

In still further exemplary embodiments, the conduit member 20 may comprise a spiral wrap member, optionally surrounded by a second spiral wrap member 38, and an outer mesh sleeve 40 surrounding the inner spiral wrap member.

Figure 7:
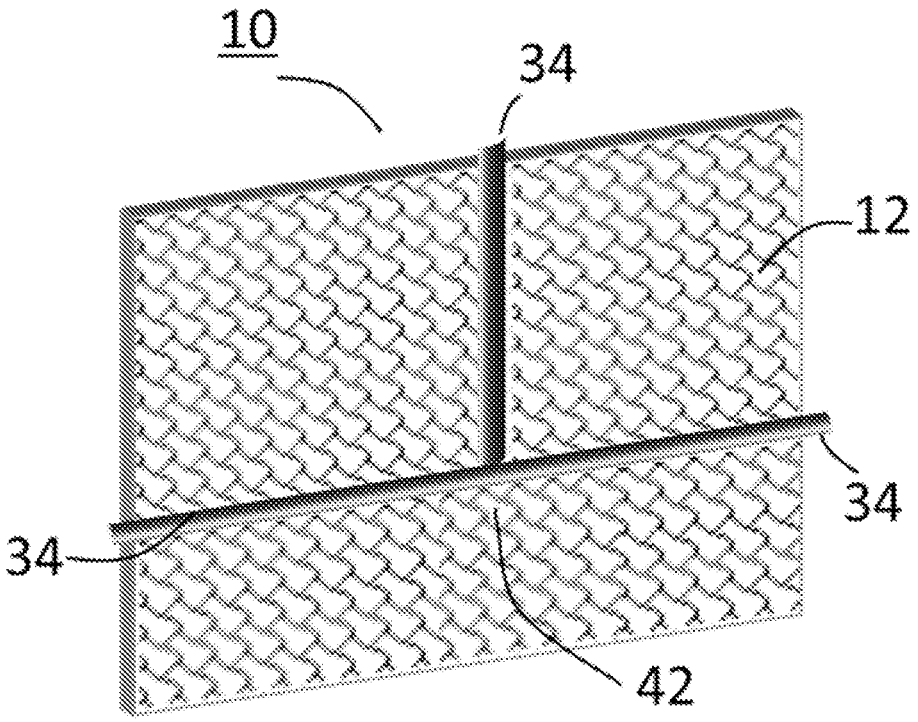
FIG. 7 is a plan diagram of another exemplary multi-layer device of the invention wherein an exemplary injection conduit member comprises a "T" structure within the device.

FIG. 7 illustrates another exemplary device 10 of the invention having an injection conduit member 34 with a "T" shape (designated at 42), thus permitting an injection fluid to be conveyed in directions parallel to both the width and length dimension of the multi-layer fluid delivery device 10. The "T" shaped injection conduit may be located between first layer 12 (e.g., nonwoven) and the second layer (film not shown), or may be located outside of the device but against the first (e.g., nonwoven) layer 12. If located outside the device 10, then it is advisable to cover the outward-disposed portion of the tubing 34 by taping it against the first layer 12 (e.g., nonwoven), such that injection fluid which is injected into the conduit 34 and through conduit openings (not illustrated for sake of simplicity) will be forced through the first layer 12 (nonwoven) and into the device 10.

Figure 8:
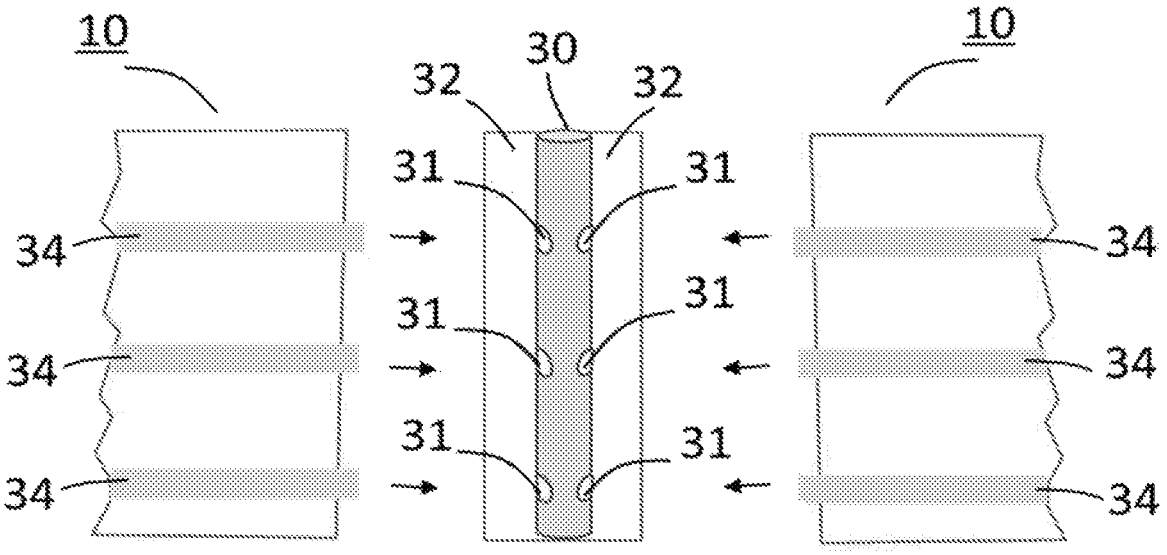
FIG. 8 is an exploded plan diagram of an exemplary connector/injection conduit member for connecting two multi-layer devices together.

As shown in FIG. 8, an assembly of two or more barrier devices 10 can be created by joining the openings 31 of an exemplary connector conduit member 30. The exemplary conduit member 30, in this case, is illustrated as tubing having openings 31 for conveying an injection fluid into other conduit members 34 or, alternatively, for using a vacuum (negative pressure) to pull injection fluid from the ends of other conduit members 34. The conduit member 30, as shown in FIG. 8, is located along an edge (width or length) of two adjacent devices (both designated as at 10). The connector conduit member 30 is shown having optional flanges 32, which can be created by attaching a tape or sheet upon which a two-sided tape can be used, to facilitate joining multi-layer devices (10) together. The devices (10) may have injection conduit members (34) located inside the devices or outside of the devices. Again, the conduit members can be taped against a nonwoven first layer of the device such that an injection fluid can flow out of the conduit members 34 and into the open-matrix layers of the devices 10.

In a further exemplary multi-layer fluid delivery device 10 of the invention, the first layer 12 is a non-woven material and the second layer 14 is a polymer film material, wherein the first and second layers 12/14 are generally co-extensive with each other, the device having generally parallel edges along its width and length dimensions. The multi-layer device 10 may have at least one injection conduit member 20 contained between the first and second layers 12/14 and/or against an edge or outward face of the first (nonwoven layer. At least one conduit member, as illustrated in FIG. 1, may extend the full width or length dimension of the device 10, with the conduit member comprising a tubing having slit openings for conducting an injection fluid between the first and second layers 12/14 and into the space defined by the open-matrix intermediate layer 16, the conduit member 20 having at least one surrounding layer to protect the openings of the inner slit openings from clogging. Alternatively, the injection conduit member 20 may be located outside of the device, such as against the outward face of the first layer 12 such that injection fluid exits the device and flows through the nonwoven material of the first layer 12 and into the open-matrix intermediate layer 16. The polymer film layer 14 optionally has a pressure-sensitive adhesive layer 22 attached on a face 14 opposite the open-matrix intermediate layer 16, to facilitate installation of the multi-layer device against a substrate.

In other exemplary devices 10, one end of the conduit member 20 member and the first and second layers 12/14 are sealed (See e.g., FIG. 1 at 18A and 18B) to define a containment cavity for the injection fluid. The sealing can be done at the construction site, such as by using a pinch clamp or stopper to close one end of the conduit member or members 20. Tape can be used to seal conduit members 20 located against the first (nonwoven) layer 12 and/or located at the edge of one or more multi-layer devices (10) to force injection fluid which is pumped through the conduit member 20 openings to flow into the open-matrix intermediate layer 16.

As shown in FIGS. 8 and 4, the present invention also provides a method for establishing a barrier assembly for post-installation in-situ incorporation of a grout, resin, cement, or other injection fluid, comprising: connecting at least two devices 10 with an injection conduit member 30 having openings 31 in communication with the at least one injection conduit member 34 having openings for conducting an injection fluid between the first and second layers 12/14 of the at least two devices 10 and into the space defined by the open-matrix intermediate layers of the at least two devices 10.

Figure 9:
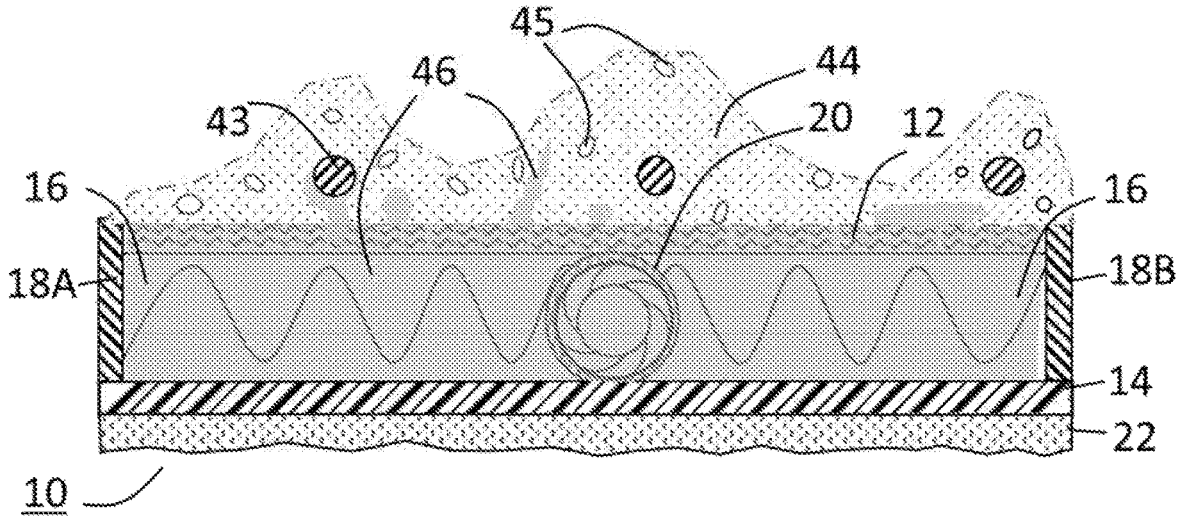
FIG. 9 is a cross-section plan diagram of a further exemplary multi-layer device of the invention, which further illustrates concrete placed against the device after installation of the device against a substrate and after installation of rebar (shown in cross-section)

FIG. 9 is a cross-section plan diagram of a further exemplary multi-layer device 10 or assembly of the invention for creating a grout wall, which further illustrates concrete 44 placed against the device 10 after installation of the device against a substrate, such as a formwork, foundation, tunnel wall, or other existing structure. The use of a nonwoven or woven fabric in the first layer 12, enables injection fluid (e.g., grout, resin, cement) to permeate out of the open-matrix layer 16 into void spaces 46 or other discontinuities in the concrete 44 which may be caused when concrete is poured or sprayed against rebar 43 which installed next to the installed device. For example, when sprayed concrete (shotcrete) is sprayed against the device 10, the rebar 43 can block the spray path, and a void space 46 is created behind the rebar (designated at 43, adjacent the void space). The void spaces could allow water to penetrate laterally between the device 10 and the concrete 44.

FIG. 9 also illustrates the use of side walls 18A and 18B which join the first layer 12 and second layer 14 and enable injection fluid to fill the open matrix layer 16 and permeate through the nonwoven first layer 12 and to fill in the void spaces (e.g., designated at 46) in the concrete 44. Where two or more barrier devices 10 are installed adjacent to each other, a continuous "grout wall" is established (e.g., against the concrete designated at 44) by the injection fluid which is present in the open-matrix layer 16, nonwoven first layer 12, and void spaces (46) which are in communication with the non-woven first layer 12.

Figure 10:
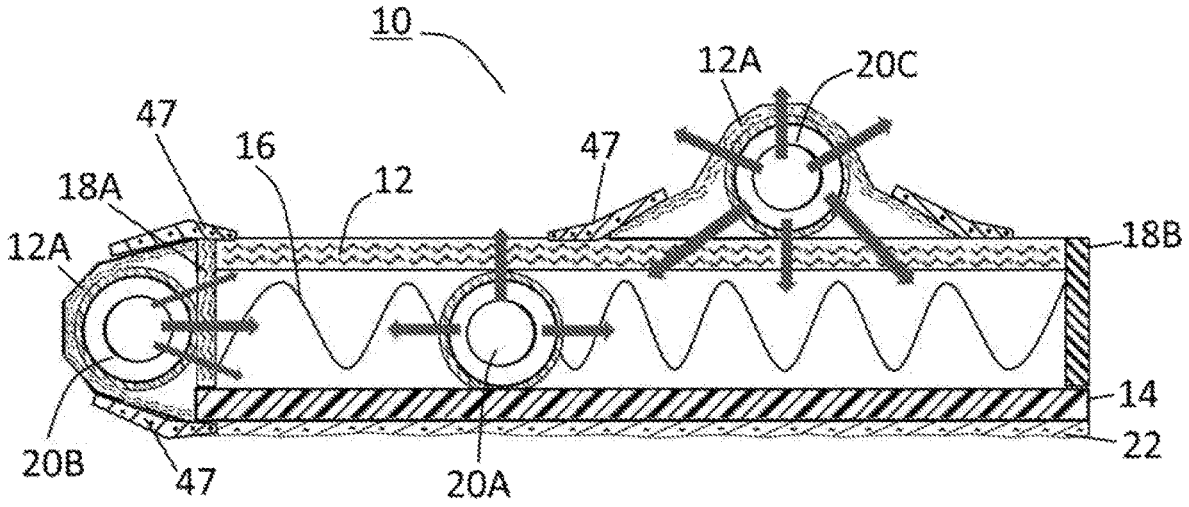
FIG. 10 is a cross-section plan diagram illustrating various locations of injection conduit tubing in, on, or alongside an exemplary multi-layer barrier device.

As illustrated in the cross-section plan diagram of FIG. 10, injection conduit members 20 (shown as two layer tubing for simplicity and with arrows to designate flow of injection fluid through slit openings which are not shown) may be located in any number of positions in or adjacent to the structure of the multi-layer barrier device 10. The most preferred location, as designated at 20A, is to have the injection conduit tubing located parallel with respect to, and between, the first layer 12 (e.g., nonwoven or fabric layer) and second layer 14 (e.g., water-impermeable polyolefin film), and also between containment side wall 18B and non-woven side wall 18A. The injection conduit tubing may also be located adjacent the side edge ("side-edge") of the barrier device 10, as designated at 20B, where the non-woven side allows for flow out of the tubing 20B and into the open-matrix layer 16. The side-edge conduit tubing 20B is secured to the barrier using a woven or non-woven strip of material (12A) connected to the first 12 and second 14 layer, which strip is in turn further secured using a tape 47. FIG. 10 also illustrates a third option whereby injection conduit tubing (as designated at 20C, is located against the face of the outer-most layer 12 which is made of woven or non-woven material. Similar to the side-edge conduit tubing 20B, the face-mounted conduit tubing 20C can be secured to the woven or non-woven face of the first layer 12, using a woven or non-woven fabric 12A (which for example can be the same non-woven material used for the first layer 12), and this can in turned be secured further using tapes (47) similar to the side-edge tubing 20B situation explained above.

Figure 11:
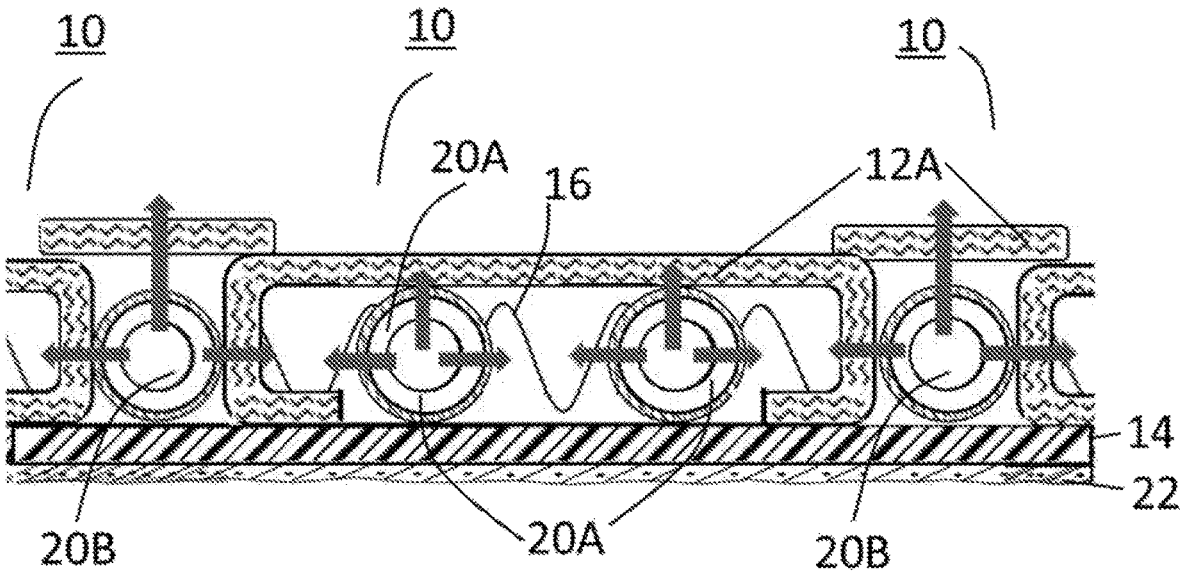
FIG. 11 is a cross-section plan diagram illustrating exemplary adjacent installation of exemplary multi-layer barrier devices.

The plan diagram of FIG. 11 shows in cross-section a further exemplary embodiment wherein a multi-layer barrier assembly, comprising two or more barrier devices (designated variously as at 10) are mounted in adjacent fashion upon a substrate or surface. In this example, at least one barrier device 10 is shown having one or more internal injection conduit tubing members (20A) for introducing an injection fluid into the open-matrix layer 16 between the first layer 12 and second 14 layer. The first layer, made for example of a non-woven material, is shown folded around its lateral edges to define opposing side-edges of non-woven material that connect (or could be adhered or melted) to join the second layer 14. Further injection conduit tubing members 20B are located at the side-edges adjacent to the individual barrier devices (10) such that injection fluid can be flowed through the adjacent devices 10 through fabric (e.g., nonwoven) material (as illustrated by arrows emanating out of the tubing designated at 20B). Strips of woven or non-woven material (designated at 12A) can be used to prevent concrete from clogging the tubing 20B while allowing injection fluid to be pumped against the concrete and thereby form a continuous grout wall with respect to injection fluid that permeates through the first layer and fabric strips 12/12A.

Also in FIG. 11, while the second layer 14 is illustrated as a water-impermeable continuous film (e.g., polyolefin film), it is possible to use strips of film that are adhered together, such as by an adhesive layer 22. It is possible, in any of the specific exemplary aspects described above or hereafter, that an impermeable film 14 (preferably having a pre-attached pressure sensitive adhesive 22) be applied first against a substrate or surface; and then individual multi-layer barrier units 10 can be adhered or formed against the installed water-impermeable film layer 14 and adhesive layer 22, by subsequent application of open-matrix structure to form the open-matrix layer 16, followed by placement of injection tubing 20A, and a (non-woven) first layer 12 to enclose the injection tubing 20A and define a containment space so that an injection fluid can fill the open-matrix layer 16 (shown with an open matrix structure for spacing apart the first layer 12 and second layer 14. Separate injection tubing 20B can then be placed side-edge wise between adjacent barrier devices 10 and covered with fabric strips (12A) to prevent clogging by concrete cast against the barrier device assemblies (designated variously at 10). Preferably, the fabric strip 12A is made of the same material (e.g., nonwoven) as the first layer 12, and attached using adhesive to secure the strip 12A to the first (outermost face) layer 12.

The various exemplary aspects of the invention may be set forth as follows.

In a first aspect of the invention, an exemplary device for post-installation in-situ barrier creation, comprises:

a multi-layer fluid delivery device comprising first and second layers defining an intermediate open-matrix layer for an injection fluid;

the first layer having an inwardly facing surface and an outwardly facing surface, the first layer being permeable to the injection fluid but at least nearly impermeable to a structural construction material to be applied against the outwardly facing surface of the first layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining an open-matrix layer for conducting an injection fluid between said first and second layers; and at least one injection conduit member disposed in parallel orientation with respect to the first layer and second layer, the at least one injection conduit member for conveying an injection fluid into the open-matrix intermediate layer air space; and the at least one injection conduit member being: (i) located within the open-matrix layer and thus between the first and second layer, (ii) located adjacent the open-matrix layer; (iii) located against the outwardly facing surface of the first layer which is permeable to injection fluid; or (iv) located in a combination or all of the foregoing locations (i), (ii), and (iii).

In a second exemplary aspect of the invention, based on the multi-layer fluid delivery device describe above in the first example, the first and second layers each have linear edges along width and length dimensions, wherein the water-impermeable second layer is a polymer film having linear edges along the width and length dimensions, and the first layer, which is permeable to the injection fluid and nearly impermeable to the structural construction material, is a non-woven or woven fabric.

In a third exemplary aspect of the invention, which may incorporate any of the first or second exemplary aspects above, the first layer and second layer each have linear width or length edges, and the least one injection conduit member is parallel to one of the linear width or length edges.

In a fourth exemplary aspect of the invention, which may incorporate any of the first through third exemplary aspects above, the fluid delivery device comprises at least one injection conduit member located between the first and second layers extends within the intermediate open-matrix layer and extending the width or length of the multi-layer fluid delivery device.

In a fifth exemplary aspect of the invention, based on any of the first through fourth exemplary aspects above, the first layer and second layer which define an intermediate open-matrix layer, and the at least one injection conduit member which is disposed within the intermediate open-matrix layer, are pre-assembled into an integral unit (i.e., before installation at a construction site).

In a sixth exemplary aspect of the invention, the device is based on any of the first through fifth exemplary aspects above, wherein the at least one injection conduit member comprises polymer tubing having openings which are resiliently movable from a closed to open position when the conduit member is filled with an injection fluid under positive pressure.

In a seventh exemplary of the invention, the device is based on any of the first through sixth exemplary aspects above, wherein the at least one injection conduit member comprises at least one spiral wrap sleeve member.

In an eighth aspect of the invention, the exemplary device is based on any of the first through seventh exemplary aspects above, wherein the at least one injection conduit member further comprises at least two spiral wrap sleeve members. As discussed above, two or more spiral wrap sleeve members are concentric, with the inner spiral wrap sleeve forming a tubing for conveying an injection fluid the length of the tubing as well as openings (between the edges of the spiral wrap) for allowing injection fluid to flow into the open-matrix layer 16 defined between the first and second layers 12/14 of the devices 10.

In a ninth aspect of the invention, the exemplary device is based on any of the first through eighth exemplary aspects above, wherein at least one injection conduit member further comprises at least one mesh sleeve member. For example, the mesh sleeve member can surround one, two, or more spiral wrap members that form the tubing through which an injection fluid is conveyed.

In a tenth aspect of the invention, based on the exemplary devices based on the ninth exemplary aspect above, the at least one injection conduit member comprises at least two spiral wrap members having opposite spiral directions, the at least two spiral wrap members being surrounded by the at least one mesh sleeve member.

In an eleventh aspect of the invention, the exemplary device is based on any of the first through tenth exemplary aspects above, wherein the at least injection conduit member consists essentially of a first spiral wrap member that is surrounded by a second spiral wrap member, and the first and second wrap members have opposite spiral directions.

In an twelfth aspect of the invention, based on the eleventh exemplary aspect above, the multi-layer fluid delivery device further comprises a mesh sleeve member surrounding the first and second spiral wrap members.

In a thirteenth aspect of the invention, wherein the device is based on any of the second through twelfth exemplary aspects above, the multi-layer fluid delivery device has at least one injection conduit member disposed parallel with respect to a linear edge of the device in the width dimension, and at least one injection conduit member disposed perpendicularly with respect to a linear edge of the device in a length or width dimension, the device being a pre-assembled unit wherein the injection conduit members form a "T" junction.

In a fourteenth aspect of the invention, wherein the multi-layer fluid delivery device is based on any of the first through thirteen exemplary aspects above, the at least one injection conduit does not terminate flush with a width edge or length edge of the multi-layer device, in that the at least one injection conduit extends beyond a width edge or length edge of the device.

In a fifteenth aspect of the invention, wherein the multi-layer fluid delivery device is based on any of the first through fourteenth exemplary aspects above, the device has at least two at least two conduits or openings of one or more conduits located at two different edges of the device, to permit two or more devices to be connected for injecting an injection fluid to form a grout curtain with a structural construction material that is cast against the two or more devices.

In a sixteenth aspect of the invention, wherein the multi-layer fluid delivery device is based on any of the first through fifteen exemplary aspects above, the outwardly facing second side of the second layer further comprises a pressure-sensitive adhesive layer for adhering the multi-layer fluid delivery device to a substrate, formwork, a building structure, or other surface.

In a seventeenth aspect of the invention, wherein the multi-layer fluid delivery device is based on any of the first through sixteenth exemplary aspects above, an end of the at least one injection conduit member is closed, and the first and second layers of the device are sealed to define a containment cavity for containing an injection fluid that is injected into the at least one injection conduit member which is closed at an end.

In an eighteen aspect of the invention, wherein the multi-layer fluid delivery device is based on any of the first through seventeenth exemplary aspects above, the device further comprises at least one tubing member penetrating the first layer (e.g., nonwoven). Such an exemplary embodiment has a number of potential benefits. First, concrete can be cast or sprayed against the first layer (and thus around tubing which will jut through the concrete, and when an injection liquid (e.g., grout, resin) is injected into the device, the jutting tubing will provide a confirmation port, so that an applicator can inject concrete into the edge-situated conduit or conduits, and obtain confirmation, by visual inspection of injection liquid emitting from the jutting tubing, that the a grout wall is being established against the concrete at the interface between the device and concrete. In a further variation of this embodiment, a multi-layer device of the invention may have an injection conduit (tubing) which is parallel to the first and second layers 12/14 and located between these layers 12/14, as well as one or more tubings which extend through the first layer (See e.g., Iske et al., U.S. Pat. No. 7,565,799). The tubing or tubings which extends through the first layer can be used as confirmation ports, so that applicators can confirm that grout, resins, cement, or other injection fluids are adequately being conveyed by other injection conduits which are located inside the barrier devices 10, such as between the first and second layers 12/14 or along outer edges of the barrier devices 10.

In a nineteenth aspect of the invention, wherein the multi-layer fluid delivery device is based on any of the first through eighteenth exemplary aspects above, the device comprises at least one injection conduit member located at an edge of the device, the edge-located at least one injection conduit member having openings disposed for allowing an injection fluid to be injected into a second multi-layer fluid delivery device installed against the edge-located at least one injection conduit member.

In a twentieth aspect of the invention, a method for waterproofing a concrete structure, the method comprises installing against a substrate chosen from e.g., formwork, wall, foundation, or existing building surface, at least one multi-layer device according to any of the foregoing first through nineteenth exemplary aspects above; and applying concrete against the at least one multi-layer device.

In a twenty-first aspect of the invention, an exemplary method based on the above twentieth aspect, comprises: installing against the substrate at least two multi-layer devices having at least one conduit member (i) located within the intermediate open-matrix layer, (ii) located at the edge of a multi-layer device and adjacent to an intermediate open-matrix layer, (iii) located along an outward face of the first layer, or (iv) located at a mixture of locations (i), (ii), and (iii), the conduit members being connected together to enable injection fluid to be injected into the at least two multi-layer devices from a common source.

In a twenty-second aspect of the invention, an exemplary method for establishing a barrier assembly for post-installation in-situ incorporation of a grout, resin, cement, or other injection fluid, comprises: installing at least two devices according to any of the foregoing first through eighteenth exemplary aspects above, in side-by-side fashion whereby the two devices are taped together and the at least one conduit member of one device is connected to the at least one conduit member of the other device; placing concrete against the at least two devices which are side-by-side; and injecting an injection fluid into the open-matrix layers of the at least two multi-layer devices simultaneously through the conduit connection, whereby a continuous grout wall curtain is established. One exemplary method for installation of two barrier devices 10 is shown in FIGS. 3A and 3B.

In a twenty-third aspect of the invention, an exemplary multi-layer fluid delivery device, comprises: first and second layers defining an intermediate open-matrix layer for an injection fluid, the first layer having an inwardly facing surface and an outwardly facing surface, the first layer comprising a non-woven synthetic fabric permeable to the injection fluid but at least nearly impermeable to concrete applied against the outwardly facing surface of the first layer, and a second layer, the second layer being water-impermeable polymer film and having an inwardly facing first side and an outwardly facing second side, the inwardly facing first side of the second layer being affixed directly or indirectly to the inwardly facing surface of the first layer such that all or a substantial portion of the second layer is spaced apart from the first layer; the device further comprising an open-matrix structure to create air space between the first layer and the second layer thereby defining an open-matrix layer for conducting an injection fluid through the multi-layered device; and the multi-layer fluid delivery device further comprising at least one injection conduit member disposed in parallel orientation with respect to the first layer and second layer, the at least one injection conduit member comprising at least one spiral wrap tube; and the at least one injection conduit member being: (i) located within the open-matrix layer and thus between the first and second layer, (ii) located adjacent the open-matrix layer; (iii) located against the outwardly facing surface of the first layer which is permeable to injection fluid; or (iv) located in a combination or all of the foregoing locations (i), (ii), and (iii).

In a twenty-fourth aspect of the invention, an exemplary method for establishing a continuous grout wall curtain against a concrete structure, comprises: providing at least two multi-layer fluid delivery assemblies, each assembly having first and second layers defining intermediate open-matrix layers for an injection fluid; the first layers having an inwardly facing surface and an outwardly facing surface, the first layers being permeable to the injection fluid but at least nearly impermeable to a structural construction material to be applied against the outwardly facing surface of the first layer, and the second layers being water-impermeable and having an inwardly facing first side and an outwardly facing second side, the inwardly facing first side of the second layers being affixed directly or indirectly to the inwardly facing surface of the first layers such that all or a substantial portion of the second layers is spaced apart from the first layers to create air space between the first layers and the second layers; and each of the multi-layer assemblies comprising at least one injection conduit member disposed in parallel orientation with respect to the first layers and second layers, the at least one injection conduit members having openings for introducing an injection fluid between the first and second layers and into the open-matrix intermediate layer air spaces, the at least one injection conduits being in communication to enable an injected fluid to flow between the adjacent multi-layer assemblies, each of the at least one injection conduits comprising at least one spiral wrap member tubing for conveying an injection fluid and openings for conveying an injection fluid; applying concrete against the at least two multi-layer fluid delivery assemblies; and introducing an injection fluid into the at least two multi-layer fluid delivery assemblies through the injection conduits which are in communication, whereby a grout wall curtain is established continuously against the concrete applied against the fluid-delivery assemblies.

In a twenty-fifth aspect of the invention, the invention provides a kit or system for making an assembly of fluid-delivery devices, comprising: at least two multi-layer devices 10 according to any of the first through nineteenth exemplary aspects above, and an injection conduit member 20 for connecting together and conveying an injection fluid simultaneously into the at least two multi-layer devices. For example, the kit may comprise two fluid delivery devices (e.g., as designated at 10 in FIG. 1, 2, or 9) and a separate connector conduit member 30 as illustrated in FIG. 8 for attaching two or more devices 10 together.

As an alternative of the foregoing exemplary aspect, the kits or system can comprise a barrier device 10 such as illustrated in FIG. 10, which has an internally located injection tubing 20A, and separate tubing with fabric strips for side-edge placement (of tubing designated at 20B in FIG. 10), face-side placement (of tubing designated at 20C in FIG. 10), or a combination of all three tubing placement locations (20A/20B/20C).

As a further alternative of the foregoing exemplary aspect, the kits or system can comprise at least two barrier devices which comprise at least three sides which are made of woven or non-woven material (as designated at 10/12 in FIG. 11), wherein separate injection tubing 20B can be sealed, preferably using fabric strips, to protect side-edge tubing 20B from clogging from concrete poured against the outer layer 12 of the device 10.

Figure 12:
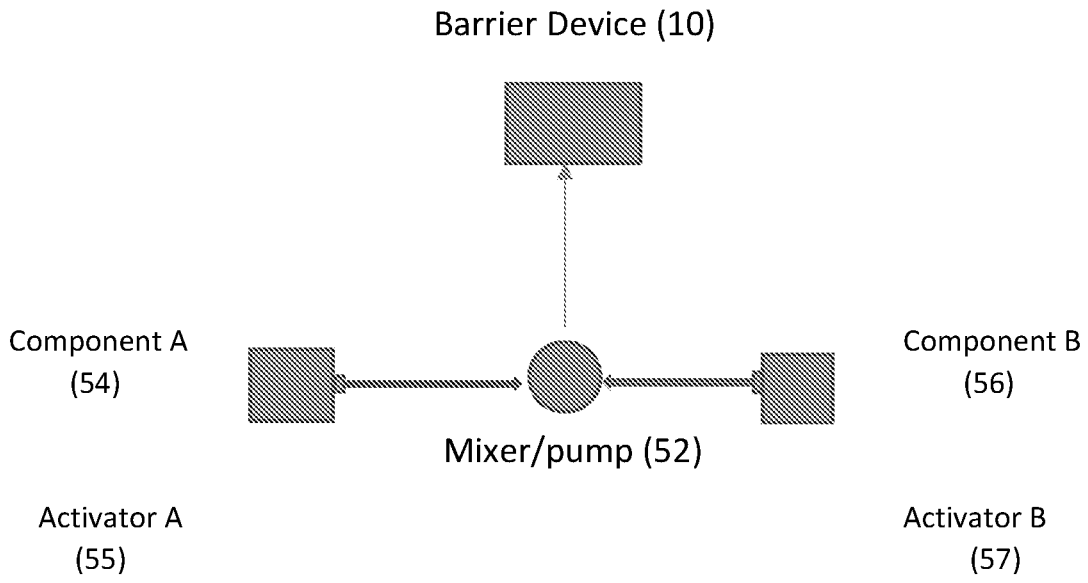
FIG. 12 is a diagram of a multi-component grout system of the prior art which requires mixing before being pumped into an (installed) multi-layer barrier device using separate mixing chamber before the grout pump.

Further exemplary embodiments of the present invention involve a system wherein the multi-layer barrier is injected with waterproofing grout fluid using a grout pump, injection fluid components, and catalysts (gel activators). As illustrated in FIG. 12, if no activator is pre-applied or pre-installed in an installed barrier device (10), two different injection fluid Components A and B (54, 55) having two Activators A and B (55, 57) would be mixed together and pumped (52) into an installed barrier device (10). Commercially available mixer/pump (52) would combine injection fluid Components A and B (54, 56): wherein Activator A (55) is premixed with Component A (54), and Activator B (57) is premixed with Component B (56). For example, Component A could comprise an acrylate or methacrylate oligomer, an acrylate or methacrylate monomer, an acrylic acid salt, a methacrylic acid salt, and water; while Component B could comprise an emulsion of a polymer which may be further diluted with water; and Activator B could be a radical initiator which reacts with Activator A to form free radicals that initiate the polymerization of component A, and Activator A could be an amine. Thus, known multi-component grout systems could be used in combination with a barrier device 10 of the present invention in accordance with any of the foregoing first through twenty-fifth exemplary aspects described above).

In a twenty-sixth aspect of the invention, which may be based on any of the foregoing first through twenty-fifth exemplary aspects described above, a multi-layer barrier device 10 further comprise an injection fluid gelation activator (hereinafter "gel activator") within the device between the first layer and second layer. The gel activator would function to initiate or accelerate gelation, viscosity increase, and/or hardening of the injection fluid material. Locating a gel activator, such as a resin, hardener, catalyst or accelerator, within the open matrix space would avoid the need to use a multicomponent grout system as depicted in FIG. 12. In further exemplary embodiments, a single component grout pump could be used whereby injection fluid could be delivered at very high fluidity and be easy to pump; and, once the injection fluid has entered into the multi-layer barrier device, the injection fluid would come into contact with gel activator located in the multi-layer barrier device and start to increase in viscosity (gel).

In a twenty-seventh aspect, which can be based on any of the first through twenty-sixth exemplary aspects, barrier devices 10 of the invention may comprise a gel activator located on the open-matrix structure 16 between the first and second layers 12/14. Alternatively, the gel activator may be coated against the film layer 14, the open matrix layer 16 (i.e., the open mesh or nonwoven structure which defines the open cavity between layers 12 and 14), the outer layer 12, or any combination of these. In a preferred exemplary embodiment, the open-matrix structure 16 is a three-dimensional filament structure polyamide matting, having a thickness of 8-25 mm, supplied in roll form, which is attached to the first layer 14 and coated with gel activator, in the manner illustrated in FIG. 13.

Figure 13:
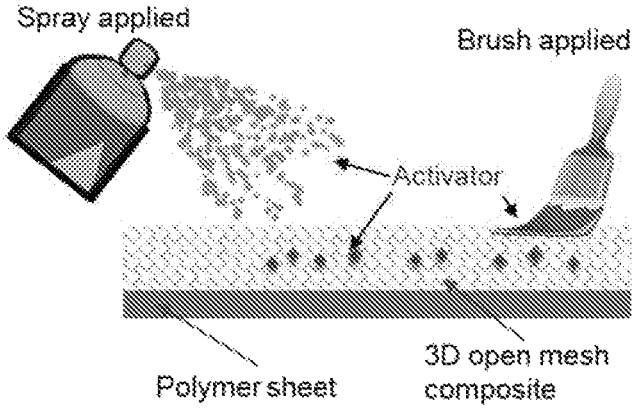
FIG. 13 is a diagram of the present invention wherein a gel activator is applied onto an exemplary open-matrix structure, e.g., non-woven geotextile structure, before the outward face (nonwoven, not illustrated) is applied.

As illustrated in FIG. 13, a gel activator is applied, such as by spray application or brushing, onto an exemplary open-matrix structure, e.g., non-woven geotextile structure, before the outward face (nonwoven, not illustrated) is applied. Other application methods may be used including dipping, extrusion, and air knife coating. While this concept allows for very flowable injection resins to be pumped into multi-layer barrier devices, and would be preferred for the use of parallel injection tubes 30; this concept can also be used for barrier devices that use outwardly extending (perpendicular) tubing, such as previously disclosed by Iske et al. in U.S. Pat. No. 7,565,779 B2, which is incorporated by reference herein. This concept may also be used for multi-layer barrier devices of the present invention and also of Iske et al. that do not use tubing or pipes to introduce injection fluid, which is introduced into the barrier devices through holes drilled into concrete cast against the installed barrier device, or which is otherwise introduced through sides of the installed barrier device.

Exemplary grout or resin components and gel activators contemplated for use in the invention include, but are not necessarily limited, to acrylics, polyurethanes, epoxies, cementitious and (sodium) silicates, for example, and may employ two components that are mixed before pumping and pumped to the desired area/location where the grout wall curtain is to be established. Thus, one of the components may be located or positioned within the open matrix structure (e.g., ENKA™ brand geotextiles or mats have an open structure and inner surfaces which could be coated with one of the components).

A gelation activator is pre-applied within the open-matrix layer defined between the first and second layers (hereinafter "gel activator"). The gel activator functions as an accelerator, catalyst, hardener, resin and/or curative agent to increase or to initiate gelation (e.g., hardening, stiffening, polymerization) of the injection fluid once it is introduced into the open matrix layer. For example, the injection fluid could be a polyol resin, and the gel activator could be an isocyanate functional resin, to generate a polyurethane grout wall composition within the barrier device.

As another example, the injection fluid could be an isocyanate resin, and the gel activator could be an amine resin, to generate a polyurea grout wall within the barrier device. An amine gel activator or a free radical gel activator could be used for polyacrylate-containing injection fluids. A still further example involves use of an epoxy resin injection fluid and amine resin as gel activator.

As another example, the gel activator for hydratable cementitious injection fluids could be a set accelerator (e.g., calcium nitrite and/or nitrate) to quicken the setting of the cement. As yet another example the injection fluid may comprise a sodium silicate solution and the gel activator may comprise an acid or an alkaline earth salt or an aluminum salt. The gel activator is pre-installed or pre-applied (e.g. coated, sprayed, brushed) into the open-matrix layer structure, such as into a non-woven geotextile mat used for separating the first and second layers of the barrier device. Consequently, a highly flowable injection fluid can be introduced into the barrier device without the need for high-powered, multi-component pump equipment. A simple single-component pump may be used. Upon contact with the gel activator located within the open-matrix layer of an installed barrier device (10), the injection fluid will begin to gel (i.e., to increase in viscosity) and ensure that a grout wall is established against concrete that was cast against the installed barrier (10).

Figure 14:
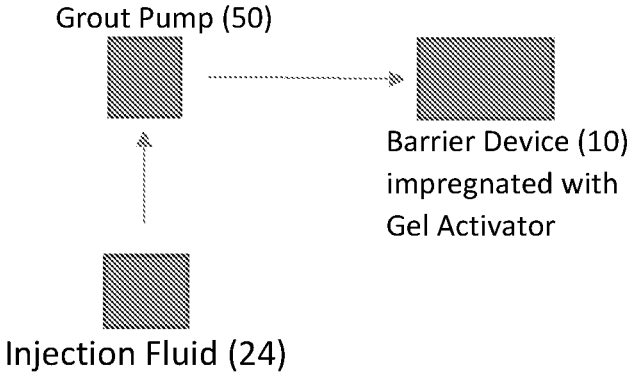
FIG. 14 is a diagram of a grout system of the present invention wherein injection fluid is pumped into an exemplary multi-layer barrier devices of the invention, which are pre-impregnated with a gel activator.

A preferred grout system of the present invention is illustrated in FIG. 14. Two example options for injection fluid 24 are described as follows. A first example injection fluid comprises Component A (54), Activator A (55), and Component B (56), borrowing the corresponding numbers from FIG. 12. Thus, for example, Component A may comprise an acrylate or methacrylate oligomer, an acrylate or methacrylate monomer, an acrylic acid salt, or a methacrylic acid salt; Component B may comprise an emulsion of a polymer; and Activator A may comprise an amine. Activator B (57) is coated within the first and second layers within the barrier device (10) and may comprise a radical initiator which reacts with Activator A to form free radicals that initiate the polymerization of Component A. Thus, injection fluid 24 can be pumped or metered into the barrier device (10) conveniently using a grout pump (50) as shown in FIG. 14.

In a second example option, the injection fluid 24 may comprise Component A (54), Component B (56), and Activator B (57) (again to borrow the numbering from FIG. 12), wherein Component A comprises an acrylate or methacrylate oligomer, an acrylate or methacrylate monomer, an acrylic acid salt, or a methacrylic acid salt; Component B comprises an emulsion of a polymer which may be further diluted with water; and Activator B comprises a radical initiator which reacts with Activator A to form free radicals that initiate the polymerization of component A. The Activator 55 is coated within the barrier device 10 (between the first and second layers), and may comprise an amine. Hence, as shown in FIG. 14, an exemplary system and method of the invention can involve minimal components to pump the injection fluid 24 using a grout pump 50 into the barrier device (10) which is impregnated with a gel activator.

It is also possible that some portion of the gel activator can be mixed into the injection fluid at a point in the injection conduit system before the injection fluid enters into the open matrix, so as to provide more time for the chemical reaction to occur. Thus, a designer or operator of the system has flexibility in terms of being able to adjust when, where, and how much of the gel activator is introduced to the injection resin, thereby enhancing control over the viscosity or other rheological characteristics of the injection resin composition during the installation process.

In a twenty-eighth aspect, the invention provides a multi-layer barrier device 10 having an impermeable film (14) and nonwoven face (12) and an open-matrix structure (16) defining an open space between layers 12 and 14, as illustrated in FIG. 1, and optionally one or more tubes, parallel or perpendicular to the layers 12/14 for introducing an injection fluid into the open space; and a gel activator located within the open space between layers 12 and 14. The gel activator may, for example, be pre-installed on an open-matrix structure (16) which has been coated with gel activator. This will allow a highly flowable injection fluid to be introduced through tubing that is perpendicular to the layers 12/14 in the manner taught by Iske et al. in U.S. Pat. No. 7,565,779 B2, or through tubing that is parallel to layers 12/14, as described and illustrated in any of the exemplary first through twenty-fifth aspects above.

Thus, an exemplary device for post-installation in-situ barrier creation, comprises: a multi-layer fluid delivery device comprising first and second layers defining an intermediate open-matrix layer for an injection fluid; the first layer having an inwardly facing surface and an outwardly facing surface, the first layer being permeable to the injection fluid but at least nearly impermeable to a structural construction material to be applied against the outwardly facing surface of the first layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining an open-matrix layer for conducting an injection fluid between said first and second layers; and a gel activator located within the space defined by the open-matrix structure.

In a twenty-ninth aspect, which can be based any of the foregoing first through twenty-eighth exemplary aspects, a barrier device of the invention further comprises tubing for introducing an injection fluid into the device, the tubing being disposed (i) in parallel orientation with respect to the first and second layers, (ii) perpendicularly with respect to the first and second layers, or (iii) in both parallel and perpendicular orientations with respect to the first and second layers.

The invention also provides packages or systems wherein the exemplary barrier devices 10 can be shipped or sold together along with injection fluids that correspond with gel activators contained in the device 10. The use of gel activator located within the cavity of the multi-barrier device, preferably located on the open-matrix structure (26), is particularly advantageous when internal conduit tubing (20) is used for conveying injection fluid into the device, as described in the first through twentieth exemplary aspects, as highly flowable injection fluid can be used, and this would greatly facilitate quick and efficient completion of a grout wall waterproofing project, and ensure that the injection fluid would be able to flow into even the minutest of cracks in the concrete situated against the non-woven face 12 of the barrier device 10.

In a thirtieth aspect of the invention, which may be based on any of the foregoing first through twenty-ninth exemplary aspects, the barrier wall device is connected to a source of positive pressure, negative pressure (e.g., vacuum), or combination of positive pressure and negative pressure sources.

While the foregoing specification sets forth various principles, preferred embodiments, and modes of operation, the present invention is not limited to the particular forms disclosed, since these are illustrative rather than restrictive. Skilled artisans can make variations and changes based on the specification without departing from the spirit of the invention.

It is claimed:

1. A device for post-installation in-situ barrier creation, comprising:

a multi-layer fluid delivery device comprising first and second substantially coextensive layers defining an intermediate open-matrix layer for an injection fluid;

the first layer having an inwardly facing surface and an outwardly facing surface, the first layer being permeable to the injection fluid but at least nearly impermeable to a structural construction material to be applied against the outwardly facing surface of the first layer, such that the structural construction material can flow into interstices of the first layer to create a bond with the structural construction material when the structural construction material hardens but the structural construction material cannot entirely penetrate into the intermediate open-matrix layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining the open-matrix layer for conducting the injection fluid between said first and second layers; and at least one injection conduit member disposed in parallel orientation with respect to the first layer and second layer and extending at least a full width or length of the substantially co-extensive first and second layers, the at least one injection conduit member for conveying the injection fluid into the open-matrix layer air space to form a continuous grout wall within the open-matrix layer between the second layer and a combination of the second layer and a combination of the first layer and the hardened structural construction material; and the at least one injection conduit member being: (i) located within the open-matrix layer and thus between the first and second layer, (ii) located adjacent the open-matrix layer; (iii) located against the outwardly facing surface of the first layer which is permeable to injection fluid; or (iv) located in a combination of all of the foregoing locations (i), (ii), and (iii).

2. The device of claim 1 wherein the first layer, which is permeable to the injection fluid and nearly impermeable to the structural construction material, comprises a non-woven or woven fabric.

3. The device of claim 1 wherein the first layer and second layer each have linear width or length edges, and the least one injection conduit member is parallel to one of the linear width or length edges.

4. The device of claim 3 wherein the at least one injection conduit member is located between the first and second layers, extends within the intermediate open-matrix layer, and extends the width or length of the multi-layer fluid delivery device.

5. The device of claim 1 wherein the at least one injection conduit member comprises polymer tubing having openings which are resiliently movable from a closed to open position when the conduit member is filled with an injection fluid under positive pressure.

6. The device of claim 1 wherein the at least one injection conduit member comprises at least one spiral wrap sleeve member.

7. The device of claim 6 wherein the at least one injection conduit member further comprises at least one mesh sleeve member.

8. The device of claim 7 wherein the at least one injection conduit member comprises at least two spiral wrap members having the same spiral directions, the at least two spiral wrap members being surrounded by the at least one mesh sleeve member.

9. The device of claim 1 wherein the at least one injection conduit member comprises a first injection conduit member disposed parallel with respect to a linear edge of the device in the width dimension, and a second injection conduit member disposed perpendicularly with respect to a linear edge of the device in a length or width dimension, wherein the first and second injection conduit members form a "T" junction.

10. The device of claim 1 wherein the at least one injection conduit member does not terminate flush with a width edge or length edge of the first and second layers, in that the at least one injection conduit extends beyond a width edge or length edge of the first and second layers.

11. The device of claim 1, further comprising a pressure-sensitive adhesive layer disposed on the outwardly facing second side of the second layer for adhering the multi-layer fluid delivery device to a substrate, formwork, a building structure, or other surface.

12. The device of claim 1 wherein an end of the at least one injection conduit member is closed, and the first and second layers of the device are sealed to define a containment cavity for containing an injection fluid that is injected into the at least one injection conduit member which is closed at an end.

13. The device of claim 1 wherein the at least one injection conduit member penetrates the first layer.

14. The device of claim 1 wherein the at least one injection conduit member is located at an edge of the device, the edge-located at least one injection conduit member having openings for allowing an injection fluid to be injected into a second multi-layer fluid delivery device installed against the edge-located at least one injection conduit member.

15. The device of claim 1 further comprising a gel activator located between the first layer and the second layer for initiating or accelerating gelation of an injection fluid introduced in the intermediate open-matrix layer.

16. A method for waterproofing a concrete structure comprising: installing against a substrate chosen from a formwork, wall, foundation, or other existing building surface, at least one multi-layer device according to claim 1; and subsequently applying concrete against the at least one multi-layer device.

17. The method of claim 16 comprising installing against a substrate at least two multi-layer devices each having at least one conduit member (i) located within the intermediate open-matrix layer, (ii) located at the edge of a multi-layer device and adjacent to an intermediate open-matrix layer, (iii) located along an outward face of the first layer, or (iv) located at a mixture of locations (i), (ii), and (iii), the conduit members being connected together to enable injection fluid to be injected into the at least two multi-layer devices from a common source.

18. Method for establishing a continuous grout wall curtain against a concrete structure, comprising:

providing at least two multi-layer fluid delivery assemblies, each assembly having substantially coextensive first and second layers defining intermediate open-matrix layers for an injection fluid; the first layers having an inwardly facing surface and an outwardly facing surface, the first layers being permeable to the injection fluid but at least nearly impermeable to a structural construction material to be applied against the outwardly facing surface of the first layer, and the second layers being water-impermeable and having an inwardly facing first side and an outwardly facing second side, the inwardly facing first side of the second layers being affixed directly or indirectly to the inwardly facing surface of the first layers such that all or a substantial portion of the second layers is spaced apart from the first layers to create air space between the first layers and the second layers; and each of the multi-layer assemblies comprising at least one injection conduit member disposed in parallel orientation with respect to the first layers and second layers and extending at least a full width or length of the substantially co-extensive first and second layers, the at least one injection conduit members having openings for introducing an injection fluid between the first and second layers and into the intermediate open-matrix layer air spaces, the at least one injection conduits being in communication with each other to enable an injected fluid to flow between the adjacent multi-layer assemblies to form the continuous grout wall curtain within the open-matrix layers between the second layers and combinations of the first layers and hardened structural construction material, each of the at least one injection conduits comprising at least one spiral wrap member tubing for conveying the injection fluid;

applying concrete against the at least two multi-layer fluid delivery assemblies; and forming a continuous grout wall between the substantially co-extensive first and second layers and against the concrete applied against the fluid-delivery assemblies by introducing an injection fluid into the at least two multi-layer fluid delivery assemblies through the injection conduits which are in communication.

19. A device for post-installation in-situ barrier creation, comprising:

a multi-layer fluid delivery device comprising substantially coextensive first and second layers defining an intermediate open-matrix layer for an injection fluid;

the first layer having an inwardly facing surface and an outwardly facing surface, the first layer being permeable to the injection fluid but at least nearly impermeable to a structural construction material to be applied against the outwardly facing surface of the first layer, and the second layer being water-impermeable and having an inwardly facing first side and an outwardly facing second side, the inwardly facing first side of the second layer being affixed, directly or indirectly to the inwardly facing surface of the first layer such that all or a substantial portion of the second layer is spaced apart from the first layer, using an open-matrix structure to create air space between the first layer and the second layer and thereby defining the open-matrix layer for conducting an injection fluid between said first and second layers to form a continuous grout wall within the open-matrix layer between the second layer and a combination of the first layer and hardened structural construction material; and a gel activator located within the space defined by the open-matrix structure.

20. The device of claim 19 further comprising tubing for introducing an injection fluid into the device, the tubing being disposed (i) in parallel with the first and second layers, (ii) perpendicularly with respect to the first and second layers, or (iii) in both parallel and perpendicular orientations.

* * * * *